US010392831B2

(12) United States Patent
Maniaci

(10) Patent No.: US 10,392,831 B2
(45) Date of Patent: Aug. 27, 2019

(54) DEAD-LATCHING SLAM BOLT LOCK

(71) Applicant: American Security Products Co., Fontana, CA (US)

(72) Inventor: Anthony C. Maniaci, Temecula, CA (US)

(73) Assignee: AMERICAN SECURITY PRODUCTS CO., Fontana, CA (US)

( * ) Notice: Subject to any disclaimer, the term of this patent is extended or adjusted under 35 U.S.C. 154(b) by 352 days.

(21) Appl. No.: 15/280,048

(22) Filed: Sep. 29, 2016

(65) Prior Publication Data

US 2017/0122003 A1 May 4, 2017

Related U.S. Application Data

(60) Provisional application No. 62/248,045, filed on Oct. 29, 2015.

(51) Int. Cl.
*E05B 15/00* (2006.01)
*E05B 17/20* (2006.01)
(Continued)

(52) U.S. Cl.
CPC ..... *E05B 15/0086* (2013.01); *E05B 17/2019* (2013.01); *E05B 47/0603* (2013.01); *E05B 63/20* (2013.01); *E05B 65/0075* (2013.01)

(58) Field of Classification Search
CPC ..... Y10T 70/7051; Y10T 70/7062; Y10T 70/7068; Y10T 70/7102; Y10T 70/7113; Y10T 292/1043; Y10T 292/1051; Y10T 292/1054; Y10T 292/1055; Y10T 292/1056; Y10T 292/1062; Y10T 292/1076; Y10T 292/1077; Y10T 292/1078; Y10T 292/1082; Y10T 292/1021; Y10T 292/696; Y10T 292/699; Y10T 292/702; Y10T 292/54; Y10T 292/564; Y10T 292/1092; Y10T 292/1039; Y10T 292/10395; Y10T 292/1047; E05B 47/00; E05B 47/0002; E05B 47/0603;
(Continued)

(56) References Cited

U.S. PATENT DOCUMENTS 1,370,681 A * 3/1921 Bloxsom ..... E05B 63/20 292/336
3,235,124 A * 2/1966 Kuever ..... B01J 3/03 292/44
(Continued)

*Primary Examiner* — Alyson M Merlino
(74) *Attorney, Agent, or Firm* — SoCal IP Law Group LLP; Steven C. Sereboff; Guy Cumberbatch

(57) ABSTRACT

There is disclosed a dead-latching slam bolt lock that includes a rotating dead-latching slam bolt which prevents attempts at breaking in without actuating the lock mechanism. A tongue or toggle acted on by the door jamb engages the bolt and initiates rotation thereof in the door closing direction, but is passive in the opening direction. The locking mechanism may be manual or electronic, and controls the position of a blocking element which alternately prevents and permits unlocking (rotation) of the rotating bolt. In a forward or blocking position, the blocking element prevents rotation of the bolt from a locked position, while in a retracted position the blocking element permits rotation of the bolt to an unlocked position. A spring detent plunger holds the rotating bolt in either its locked or unlocked positions.

22 Claims, 7 Drawing Sheets

(51) Int. Cl.
*E05B 63/20* (2006.01)
*E05B 47/06* (2006.01)
*E05B 65/00* (2006.01)

(58) Field of Classification Search
CPC .... E05B 47/0607; E05B 63/248; E05B 63/20; E05B 63/202; E05B 65/0075; E05B 15/0086; E05B 17/2019; E05B 17/2049; E05B 17/2053; E05B 17/208; E05B 17/203; E05B 17/2038; E05C 19/12; E05C 19/14; Y10S 292/49
See application file for complete search history.

(56) References Cited

U.S. PATENT DOCUMENTS 3,423,118 A * 1/1969 Waldo ..... E05B 65/1073 292/210
3,576,337 A * 4/1971 Gudde ..... E05B 51/02 292/201
3,600,023 A * 8/1971 Gudde ..... B64D 29/06 292/201
3,659,886 A * 5/1972 Andrews ..... E05C 19/024 292/78
3,786,657 A 1/1974 Loikitz
3,872,696 A 3/1975 Geringer
4,036,517 A * 7/1977 Talmadge ..... E05C 3/24 292/216
4,056,276 A * 11/1977 Jarvis ..... E05B 47/06 292/201
4,324,425 A 4/1982 Logan
4,545,606 A * 10/1985 Vodra ..... E05B 65/1053 292/216
4,648,253 A * 3/1987 Imhoff ..... E05B 47/0047 292/210
4,756,566 A 7/1988 Logas
4,917,425 A 4/1990 Logas
5,452,927 A 9/1995 Uyeda
5,490,699 A 2/1996 Uyeda
5,862,692 A 1/1999 Legault et al.
7,832,777 B2 * 11/2010 Banks ..... E05B 57/00 292/92
8,096,594 B2 1/2012 Uyeda
9,145,710 B2 * 9/2015 Weinerman ..... E05B 15/102

* cited by examiner

DEAD-LATCHING SLAM BOLT LOCK

RELATED APPLICATION INFORMATION

This patent claims priority under 35 U.S.C. § 119 from Provisional Patent Application No. 62/248,045, filed Oct. 29, 2015, titled DEAD-LATCHING SLAM BOLT LOCK which is expressly incorporated by reference in its entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a door lock and more particularly, to a more robust dead-latching slam bolt door lock especially useful for safes and/or lockers placed inside larger safes.

Description of the Related Art

Safes, or high security containers, come in an infinite array of designs. One primary markets is commercial safes, where safes are often designed and manufactured to the client's requirements. Many of these safes are equipped with a conventional outer safe door, but also have locker(s) inside to facilitate different cash handling methods and processes. Electronic safe locks have evolved rapidly to replace mechanical systems since their introduction in the early 1990s.

There are two fundamental locking systems used in safes:

a. Boltwork Blocking: where a safe door is held closed by robust locking bolts, carried by a common carriage bar. The locking bolts are engaged behind a stationary jamb in the safe body. The boltwork is held in the locked position by a safe lock that prevents the articulation of the common carriage bar. These locks are typically "dead-latching," meaning they can only be disengaged by the actuating the manual or electronic switch to open the lock. The carriage bar is articulated manually by a rotating or sliding handle mechanism.

b. Direct Locking: where a safe lock directly engages the stationary jamb in the safe body. The locks of this type typically include a spring-biased ramped locking bolt that is depressed as the bolt contacts and passes the stationary jamb, thus making it unnecessary to activate the lock to close the locker door. The bolt action of this type of lock would be similar to a conventional door knob-lock, except the retraction is effected by the electronic locking system controls. These locks are often referred to as "Slam Bolt Locks," as the closing action causes the spring-biased bolt to push open, then spring back behind the jamb when the door is fully closed. The name signifies that you "Slam" the door to close and lock it without any need for lock articulation.

One problem with existing direct locking slam bolt-type locks is that the contents of a safe may interfere with opening of the lock. That is, a weight applied from inside the safe on the door tends to apply an outward load. The spring-biased bolt is thus pressed outward against the door jamb, which might interfere with its smooth opening. The resulting wear imposed on surfaces that were not intended to be structurally loaded may eventually lead to failure. Further, since the bolt must be free to push in as it contacts the jamb during door closure, it likewise can be pressed in against the spring force when the door is closed, and cannot be dead-latched. This is true for solenoid or knob actuated slam bolt locks and presents a security risk, as opening can be accomplished by using a fishing probe from any opening where access may be made. This is also in contrast to a dead-latching lock which can only be disengaged by actuating the manual or electronic switch to open the lock.

There is thus a need for a more robust dead-latching slam bolt lock.

SUMMARY OF THE INVENTION

The present application discloses a more robust dead-latching slam bolt lock that is relatively unaffected by outwardly-directed loads imposed on the door from inside the container. The lock includes a rotating dead-latching slam bolt which prevents attempts at breaking in without actuating the lock mechanism. A tongue or toggle acted on by the door jamb engages the bolt and initiates rotation thereof in the door closing direction, but is passive in the opening direction. The locking mechanism may be manual or electronic, and controls the position of a blocking element which alternately prevents and permits unlocking (rotation) of the rotating bolt. In a forward or blocking position, the blocking element prevents rotation of the bolt from a locked position, while in a retracted position the blocking element permits rotation of the bolt to an unlocked position. A spring detent plunger holds the rotating bolt in either its locked or unlocked positions.

The disclosed lock includes a tongue or toggle, and is specific to the direct-locking door application. The present lock works on the plane of intended action, and is engineered to provide greater holding strength. The present lock actuates in an axial direction following the direction of door travel. It is mechanically stronger in the direction of door motion. The present lock provides better actuation, as it uses a rotational actuation path for the bolt that follows the geometry of the closure mechanics. The present lock is held in the locked position by a strong spring detent plunger that prevents the unintended loads from hindering the lock actuation. The present lock bolt is a rotating component that is blocked by a solenoid or other manual or electro-mechanical actuator. When the actuator is energized, the door can be pulled with moderate force to cause the bolt to "toggle" to the unlocked position. The spring loaded detent plunger works in an "over-center" or "bi-stable" action to also hold the bolt in an unlocked condition one the door is pulled open. There is a spring loaded release bar in the bolt that contacts the jam during closure, which trips the rotating bolt back into the locking position. The present lock is dead-locking, and cannot be articulated without using the intended electronics to actuate the blocking device. Once the lock is actuated, the door is opened by simply pulling on a knob. Once the bolt is locked, it cannot be moved to an unlocked position unless the internal blocking actuator is activated to provide the freedom of motion to rotate open.

Throughout this description, elements appearing in figures are assigned three-digit reference designators, where the most significant digit is the figure number where the element is introduced and the two least significant digits are specific to the element. An element that is not described in conjunction with a figure may be presumed to have the same characteristics and function as a previously-described element having the same reference designator.

DETAILED DESCRIPTION

The present application discloses an improved direct-latching lock of the slam-bolt variety. The lock partly relies on a tongue or toggle, and thus will be termed a "toggle lock" herein. The toggle lock is especially beneficial for use on lockers placed within larger safes, but may also be used as a safe lock as well as a lock for any door closure. The bolt for the toggle lock preferably rotates, though a linearly-actuated bolt for a toggle lock otherwise having the same features is contemplated; thus the term "displacement" for the bolt encompasses any possible form of movement.

Figure 1A:
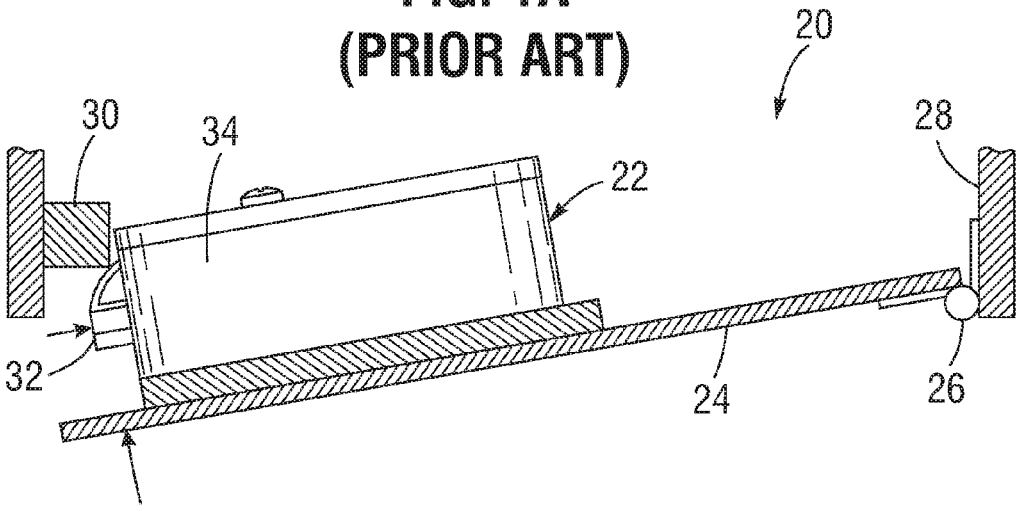
FIG. 1A (PRIOR ART)
FIG. 1A is a horizontal sectional view through a door being closed showing a prior art slam bolt lock thereon.

FIG. 1A is a horizontal sectional view through a door 20 being closed showing a prior art slam bolt lock 22 mounted thereon. The door includes a front panel 24 mounted on one or more hinges 26 to a door frame 28, which forms a part of a safe, locker or other container of items to be secured. The slam bolt lock 22 engages a door jamb 30 on one side of the door frame 28. In the step of closing the door 20, a bolt 32 of the slam bolt lock 22 is pushed in by contact with the door jamb 30. In particular, a rear face of the bolt 32 is curved or ramped so that the jamb 30 cams the bolt 32 laterally inward into the body 34 of the slam bolt lock 22 and against the resistance of an internal spring (not shown).

Figure 1B:
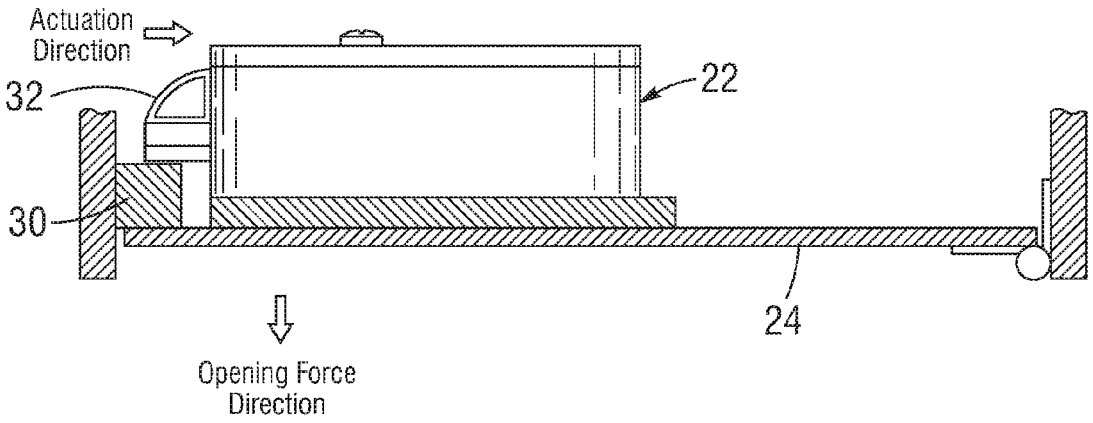
FIG. 1B (PRIOR ART)
FIG. 1B shows the bolt of the slam bolt lock engaged with a door jamb in a locked position.

FIG. 1B shows the bolt 32 of the slam bolt lock 22 engaged behind the door jamb 30 in a locked position. That is, once the front outer corner of the bolt 32 clears the door jamb 30, the internal spring pushes it back outward to its locked position. A flat front face of the bolt 32 then contacts the door jamb 30, which interference prevents the door 20 from opening. Although not shown, an internal solenoid or other actuator may be used to retract the bolt 32 laterally into an unlocked position to enable opening of the door 20. The lateral actuation direction of the bolt 32 to unlock it is shown.

As mentioned above, there are two main drawbacks to this simple design. First, the bolt 32 is not dead-latching, meaning it can be retracted laterally in the actuation direction into its unlocked position through the use of a thin tool or other such device (think of a credit card used to push back a conventional slam bolt lock in the door of a structure). Secondly, any loads imposed on the inside of the lock 22 or door panel 24 in the opening force direction tends to cause the bolt 32 to press against the door jamb 30. This interferes with the operation of the opening solenoid and may even prevent the lock 22 from functioning properly or ultimately cause damage to the lock 22.

Figure 2A:
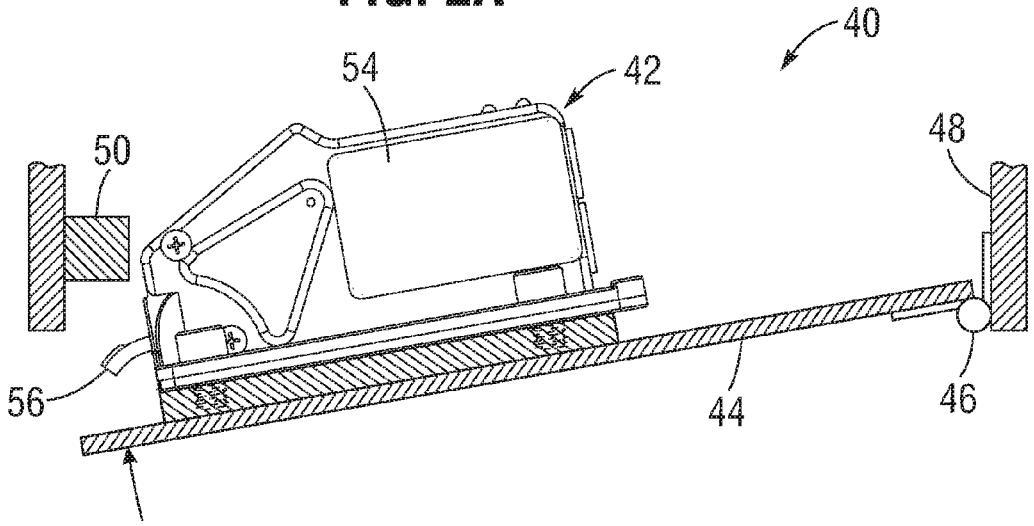
FIG. 2A is a horizontal sectional view through a door being closed showing a toggle lock of the present application thereon.
Figure 2B:
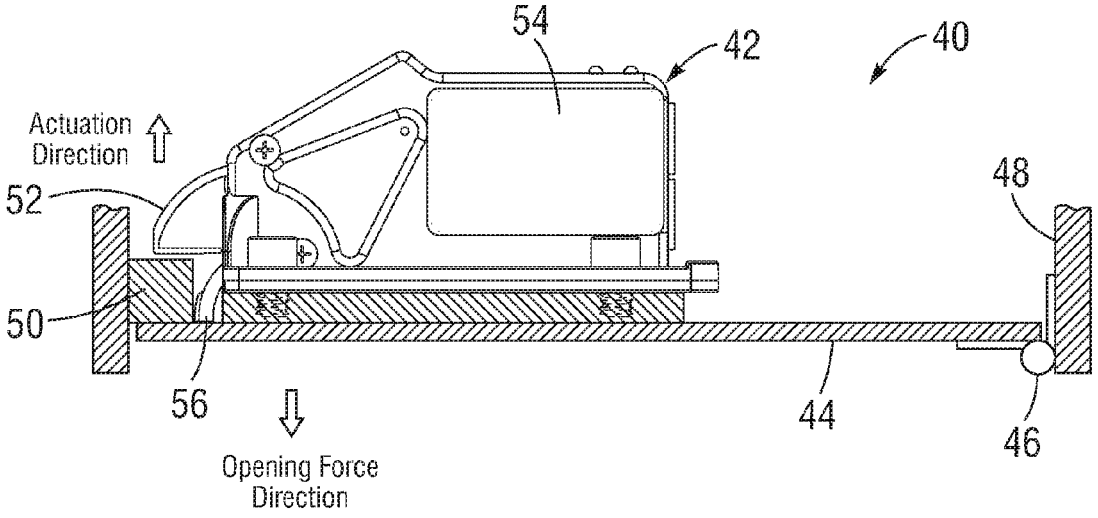
FIG. 2B shows the bolt of the toggle lock engaged with a door jamb in a locked position.

FIG. 2A is a horizontal sectional view through a door 40 being closed showing a toggle lock 42 of the present application mounted thereon. As before, the door 40 includes a front panel 44 mounted on one or more hinges 46 to a door frame 48, which forms a part of a safe, locker or other container of items to be secured. The slam bolt lock 42 engages a door jamb 50 on one side of the door frame 48. In the step of closing the door 40, a bolt 52 of the toggle lock 42 rotates from a retracted or unlocked position within a body 54 of the toggle lock 42 into an advanced or locked position as shown in FIG. 2B. It should be understood that the generic door configuration shown represents numerous locking door assemblies, and the present toggle lock will be useful in any number of such assemblies.

FIG. 2A shows a tongue or toggle 56 of the toggle lock 42 extending laterally out from the lock body 54. As the door panel 44 closes, the toggle 56 eventually contacts an outer face of the door jamb 50 causing it to rotate; a counter-clockwise (CCW) direction in the orientation shown. As will be explained below, the toggle 56 internally engages the bolt 52 and causes rotation thereof from its retracted (unlocked) position to its advanced (locked) position. The bolt 52 simply rotates into the position of FIG. 2B behind the door jamb 50, without contact therewith, while toggle 56 ends up in a resting state between the door jamb 50 and the toggle lock body 54, just inside of the door panel 44. As with the prior art slam bolt lock 22 described above, when in the advanced position a flat front face of the bolt 52 of the toggle lock 42 is juxtaposed against an inner face of the door jamb 50 and contacts the door jamb when an opening force is applied to the door panel 44, which interference prevents the door 40 from opening.

FIGS. 3A-3D are elevational views of different sides of the exemplary toggle lock 42 of the present application. As mentioned, the toggle lock 42 includes a body 54 formed of high strength steel or the like. Typically the body 54 includes two somewhat similar halves securely joined together to form a hollow interior within which the locking mechanism is mounted. The toggle lock 42 is shown in its locked state with the bolt 52 extended from within the body 54 and the toggle 56 rotated to the position as seen in FIG. 2B.

The toggle lock body 54 preferably mounts to the door panel 44 via a mounting plate 58 extending out from the body and having holes through which a plurality of Allen bolts 60 extend. More preferably, the body 54 has a plurality of outwardly-extending flanges (not shown) with elongated holes that align with the mounting plate 58 holes so that the body 54 may be adjusted laterally with respect to the door panel 44 before the bolts 60 are tightened. A small pointer 61 on the mounting plate 58 registers with a series of position markings on the body 54 for this purpose.

Figure 3A:
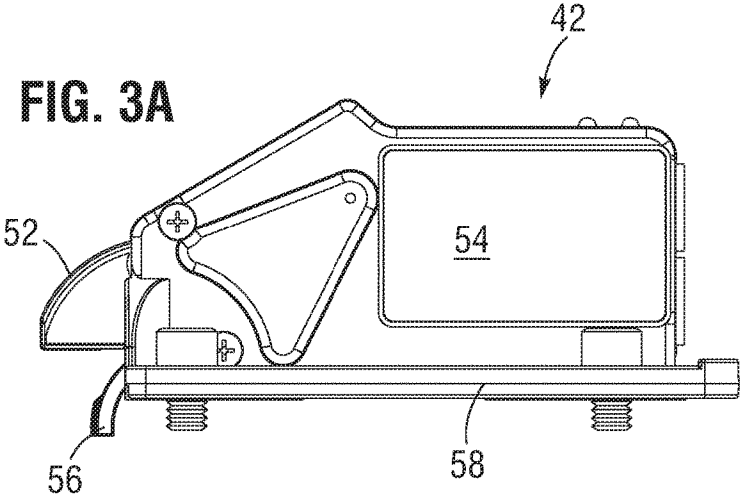
FIGS. 3A-3D are elevational views of different sides of the exemplary toggle lock of the present application.
Figure 3B:
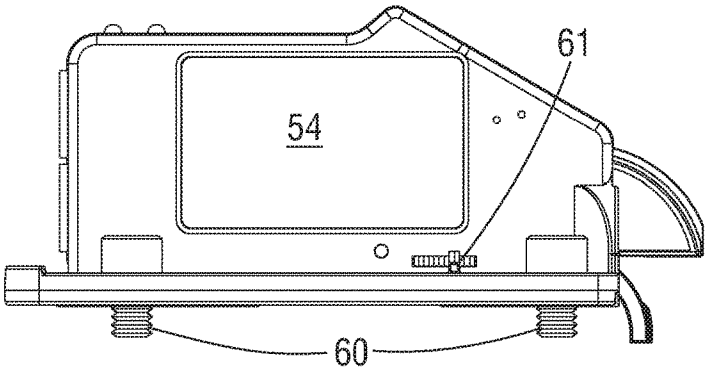
Figure 3C:
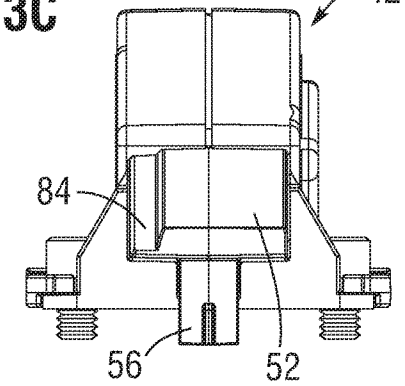
Figure 3D:
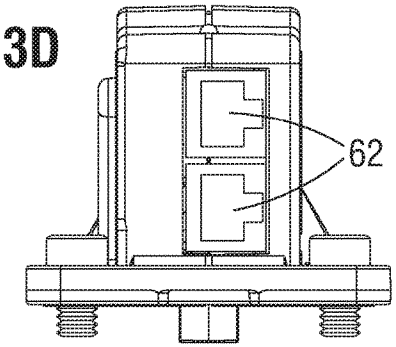

FIG. 3D shows a pair of vertically stacked communication ports 62 opening rearwardly from the body 54. Although not shown in FIGS. 2A and 2B, an electronic lock control such as a numeric touch pad will also be mounted to the door panel 44 or frame 48 and connected to the communication ports 62 to actuate the toggle lock 42. There are numerous types of such electronic lock controls available, and the present application is not limited thereby. Furthermore, although the lock actuation described herein is electro-mechanical, purely manual lock controls may also be incorporated as will be appreciated by those of skill in the art. In this sense the term "lock control" refers to both manual and electro-mechanical versions.

Figure 4A:
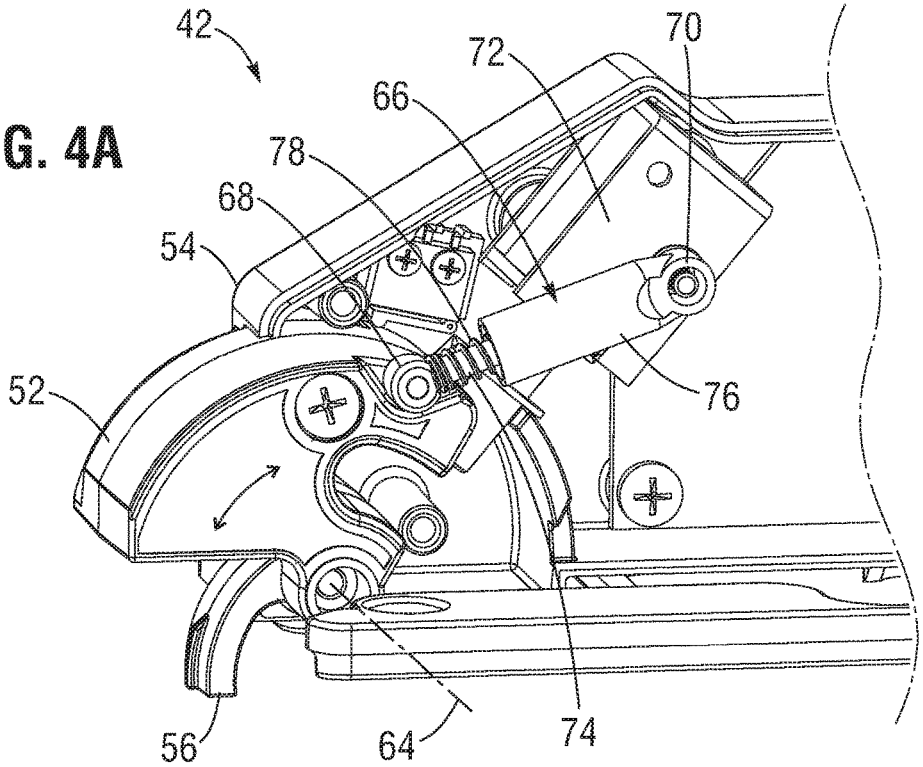
FIGS. 4A-4B are cutaway perspective views of the exemplary toggle lock from different angles and showing the mechanism in a locked configuration.
Figure 4B:
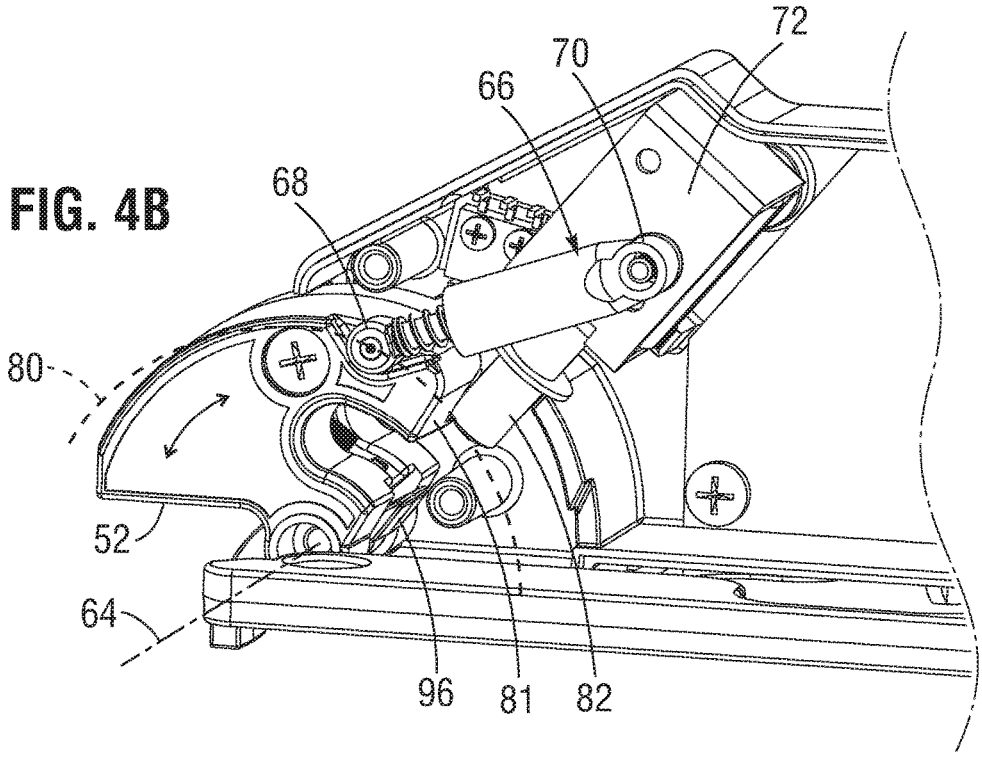

FIGS. 4A-4B are cutaway perspective views of a front portion of the exemplary toggle lock 42 of the present application. The bolt 52 is shown extending out of an aperture in the body 54 in its advanced or locked position. The bolt 52 rotates about an axis 64 fixed with respect to the body 54 via a journal bearing or simple shaft and tube arrangement. The direction of rotation is shown by a double-headed arrow. Likewise, the toggle 56 rotates about the same axis 64.

A spring-loaded detent plunger 66 has a lower end 68 rotatably mounted to a shaft stub (not numbered) carried by the bolt 52 and an upper end 70 rotatably mounted to another shaft stub (also not numbered) on a solenoid body 72 fixed within the toggle lock body 54. The shaft stub axes are parallel to the axis 64. The lower end 68 of the detent plunger 66 is thus carried by the bolt 52 when it rotates. The detent plunger 66 includes a piston 74 connected to its lower end 68 that slides within a cylinder 76 connected to its upper end 70, with a relatively strong spring 78 interposed therebetween to bias the piston out of the cylinder. The shaft stub on the bolt 52 to which the lower end 68 mounts traces an arc of rotation 80 that comes closest to the shaft stub on the solenoid body 72 at about a mid-point of travel of the bolt 52. In this way, the spring-loaded detent plunger 66 applies opposite rotational forces to the bolt 52 depending on whether the bolt is in its locked or unlocked positions. That is, the spring 78 causes the piston 74 to extend from the cylinder 76 and hold the bolt 52 in its locked and unlocked positions. The bi-stable nature of the detent plunger 66 keeps the bolts 52 advanced with the door is closed and retracted with the door is open.

Figure 5A:
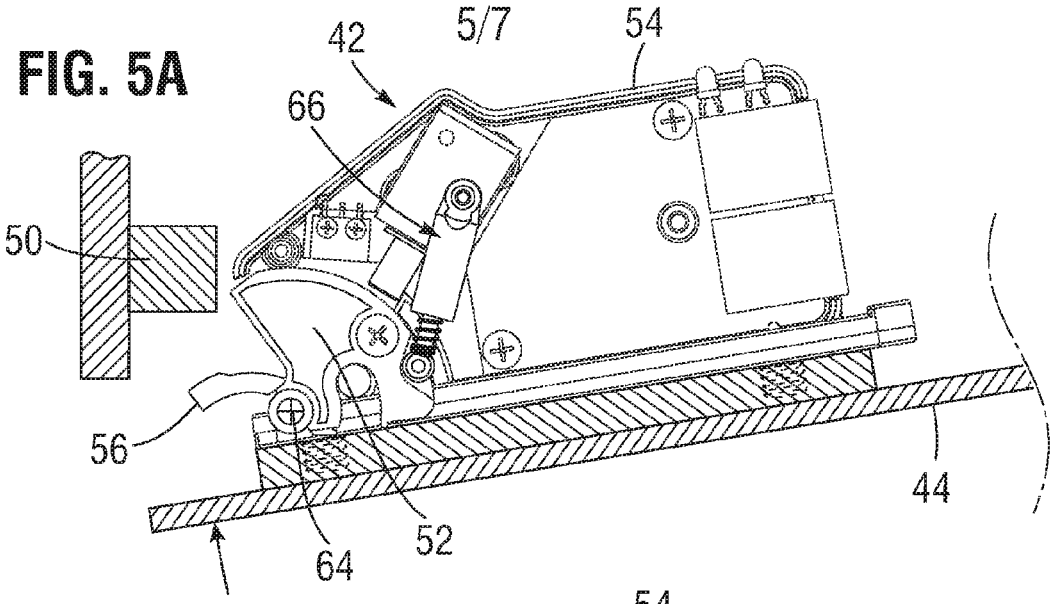
FIGS. 5A-5C are horizontal sectional views through a door having the toggle lock and showing a door closing sequence.
Figure 5B:
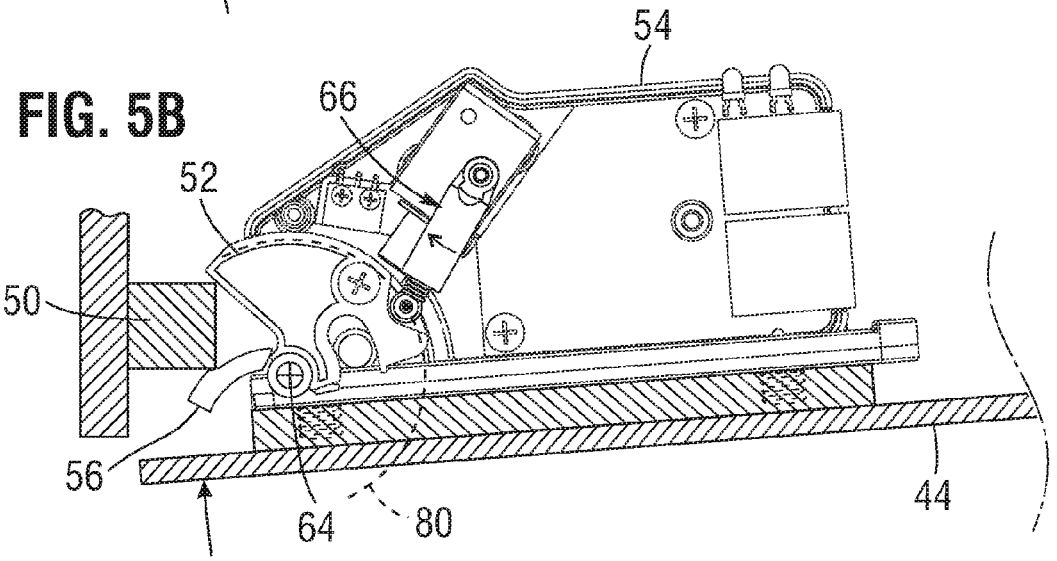
Figure 5C:
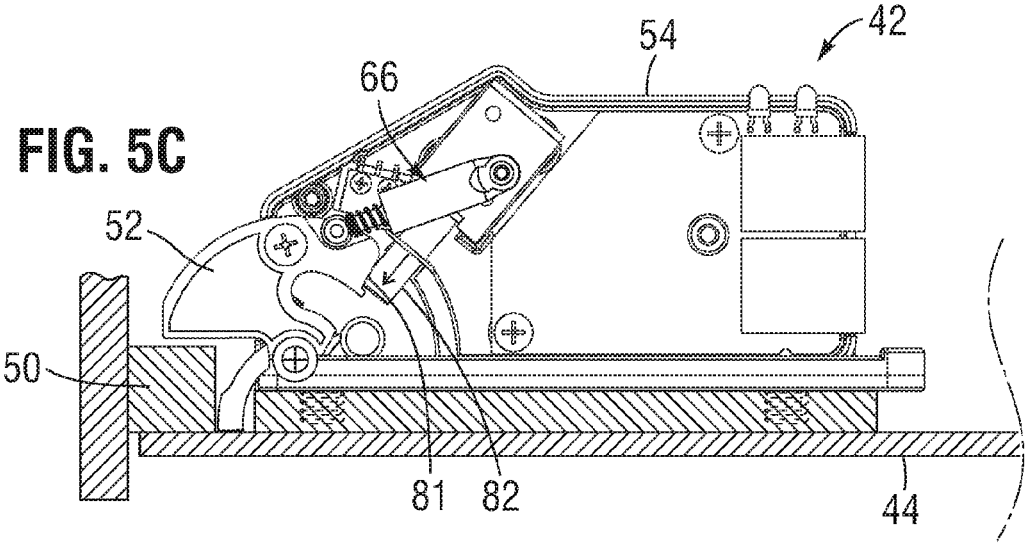

FIGS. 5A-5C are horizontal sectional views showing snapshots of closure of the door having the toggle lock 42. Initially, as in FIG. 5A, the bolt 52 is retracted into the lock body 54 with the detent plunger 66 rotated CCW past the mid-point of its travel so that is biases the bolt in that direction. As will be described, the toggle 56 is spring-biased as well in a CCW direction about the axis 64 so that it remains extending generally laterally from the lock body 54 in an extended position and in the path of the door stop 50 as the door panel 44 rotates closed.

FIG. 5B shows further closure of the door panel 44 at a point where the door stop 50 makes contact with the toggle 56 and rotates it CCW. Engagement between the toggle 56 and the bolt 52 causes likewise CCW rotation of the bolt, as shown by the movement arrow. The shape and rotational path of the bolt 52 allows it to rotate around to the back side of the door stop 50 with ease. In this moment the detent plunger 66 rotates CCW as well toward its mid-point of travel, at which time it will apply an opposite rotational bias to the bolt 52. Closure of the door panel 44 in this regard thus must overcome the force of the spring 78 on the detent plunger 66, but the weight of the door and its relatively large leverage overcomes the spring fairly easily. It should be noted that the rear face of the bolt 52 is curved as with conventional slam bolt locks, although the purpose is not for engagement with the door jamb 50, rather the curved surface facilitates rotation in and out of the body 54, and reduces the overall size of the lock 42.

Finally, FIG. 5C shows the door panel 44 closed against the door jamb 50 and the toggle lock 42 locked. The bolt 52 is fully advanced to its locked position behind the door jamb 50 and is biased into this position by the detent plunger 66. An inside face 81 of the bolt 52 travels past a point at which a solenoid shaft 82 may extend from the solenoid body 72. See also FIG. 4B where the solenoid shaft 82 is shown engaged with a chamfer 84 having a ledge that limits travel of the shaft. The chamfer 84 is shown on the front of the bolt 52 in FIG. 3C but extends around to the back side.

Imposition of the solenoid shaft 82 behind the direction of travel of the bolt 52 prevents the bolt from rotating in a clockwise (CW) direction. The solenoid body 72 preferably has a direct drive solenoid coil and magnet within that has a relaxed state when the solenoid shaft 82 extends, and when energized pulls the solenoid shaft 82 back into its housing. The solenoid is actuated via signals received by the communication ports 62. This linear movement of the solenoid shaft 82 may also be accomplished by a purely mechanical lock control, as mentioned, and the solenoid shaft 82 may rotate into its locked position rather than translate. Variations on these mechanisms are well known in the art, and the general term "blocking member" will be used to encompass the solenoid shaft 82 as well as other equivalent structures.

Figure 6A:
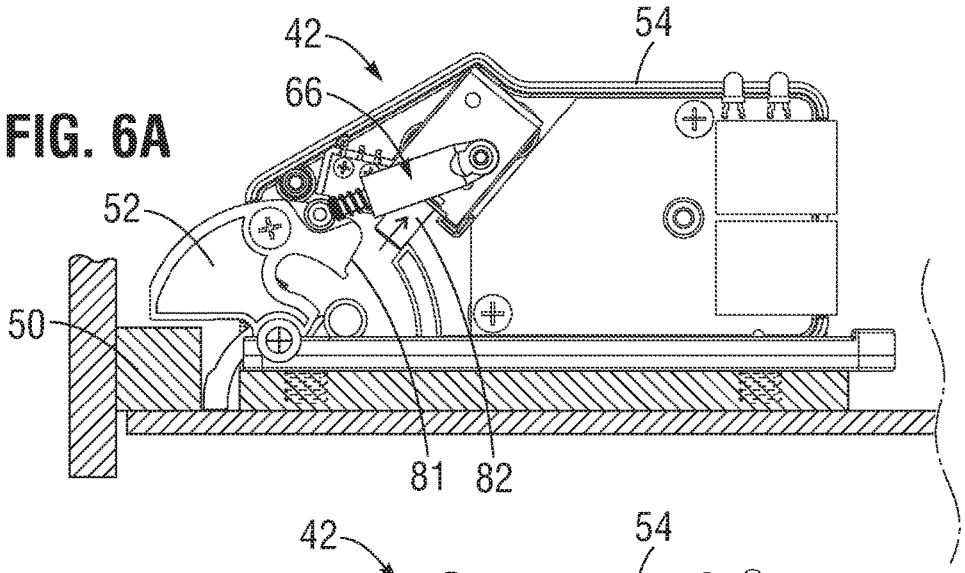
FIGS. 6A-6C are horizontal sectional views through a door having the toggle lock and showing a door opening sequence.
Figure 6B:
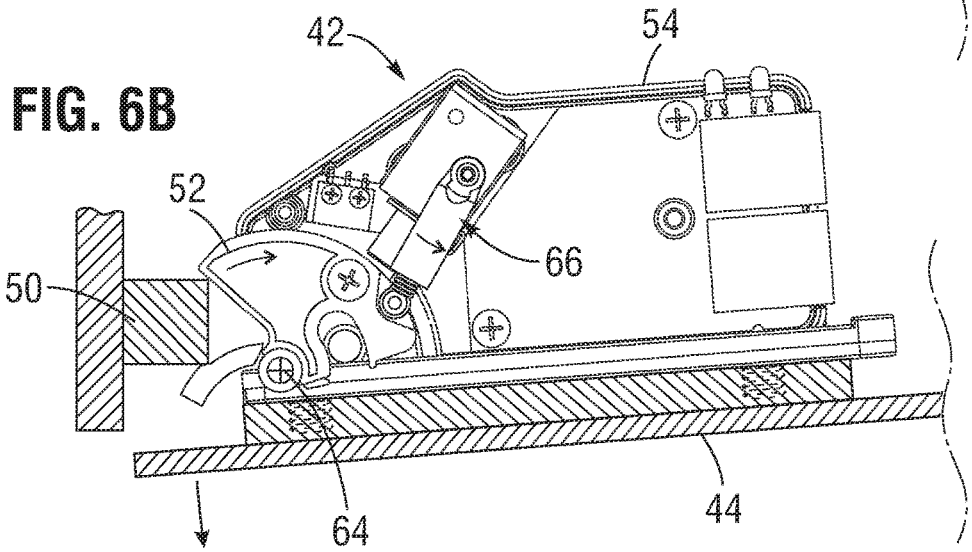
Figure 6C:
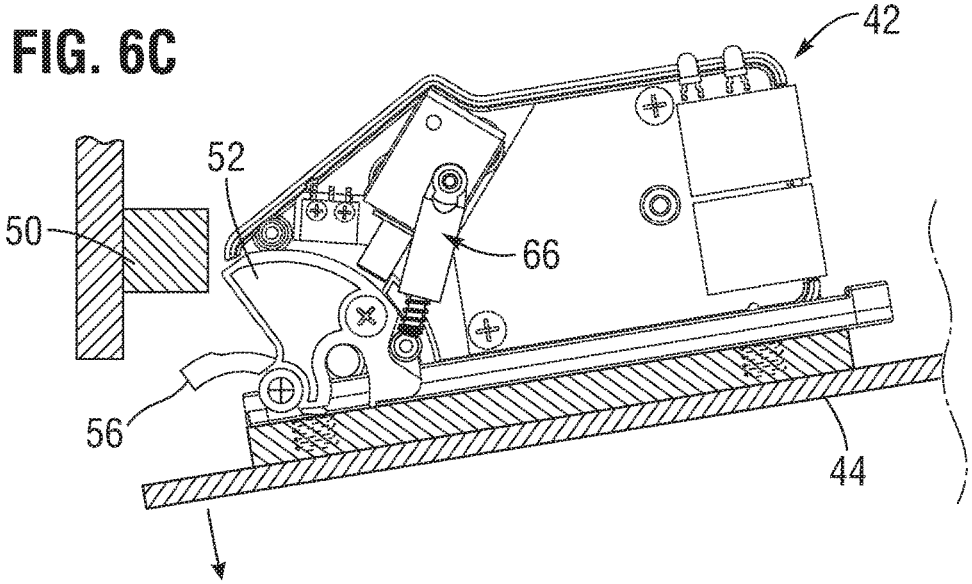

FIGS. 6A-6C are horizontal sectional views showing opening of the door panel 44 having the toggle lock 42. Initially, the lock control is actuated so that the solenoid shaft 82 (or blocking member) retracts from within the rotational path of the bolt 52. That is, the solenoid shaft 82 no longer abuts the inside face 81 of the bolt 52. At this stage the bolt 52 remains in its locked position, but there is no longer anything preventing its movement other than the bias of the spring detent plunger 66.

FIG. 6B shows the door panel 44 being opened such that the door jamb 50 contacts and rotates the bolt 52 in a CW direction about the axis 64. Eventually the bolt 52 rotates far enough so that the detent plunger 66 passes the bi-stable point and consequently biases the bolt in the CW direction.

Finally, FIG. 6C shows the bolt 52 fully retracted within the lock body 54 and held in this position by the detent plunger 66. The lock 42 is fully open. It should be noted that actuation of the solenoid will not cause extension of the solenoid shaft 82 because of the presence of the bolt 52. In this manner the door panel 44 is not prevented from closing. Desirably, with an electronic lock control, an attempt to actuate the solenoid when the door is open returns an error message.

Figure 7A:
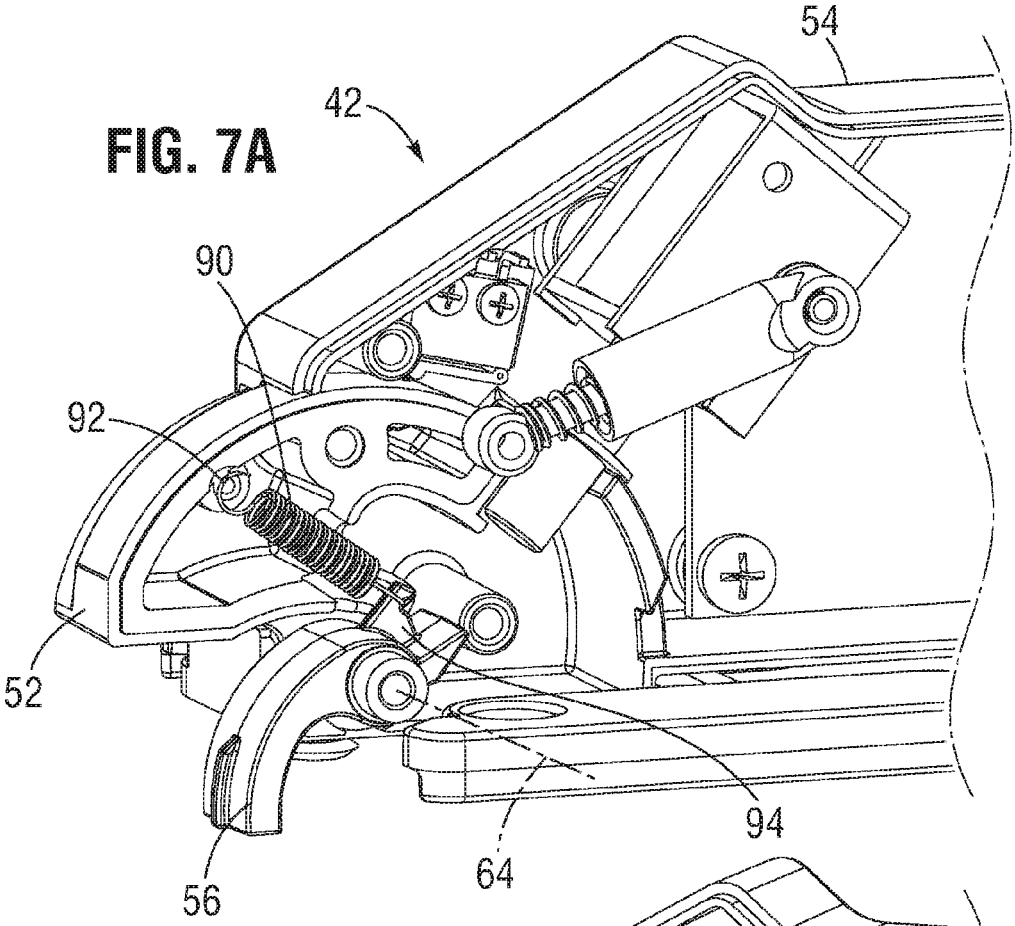
FIGS. 7A-7B are cutaway perspective views of the exemplary toggle lock showing engagement of a tongue or toggle with the rotating bolt.
Figure 7B:
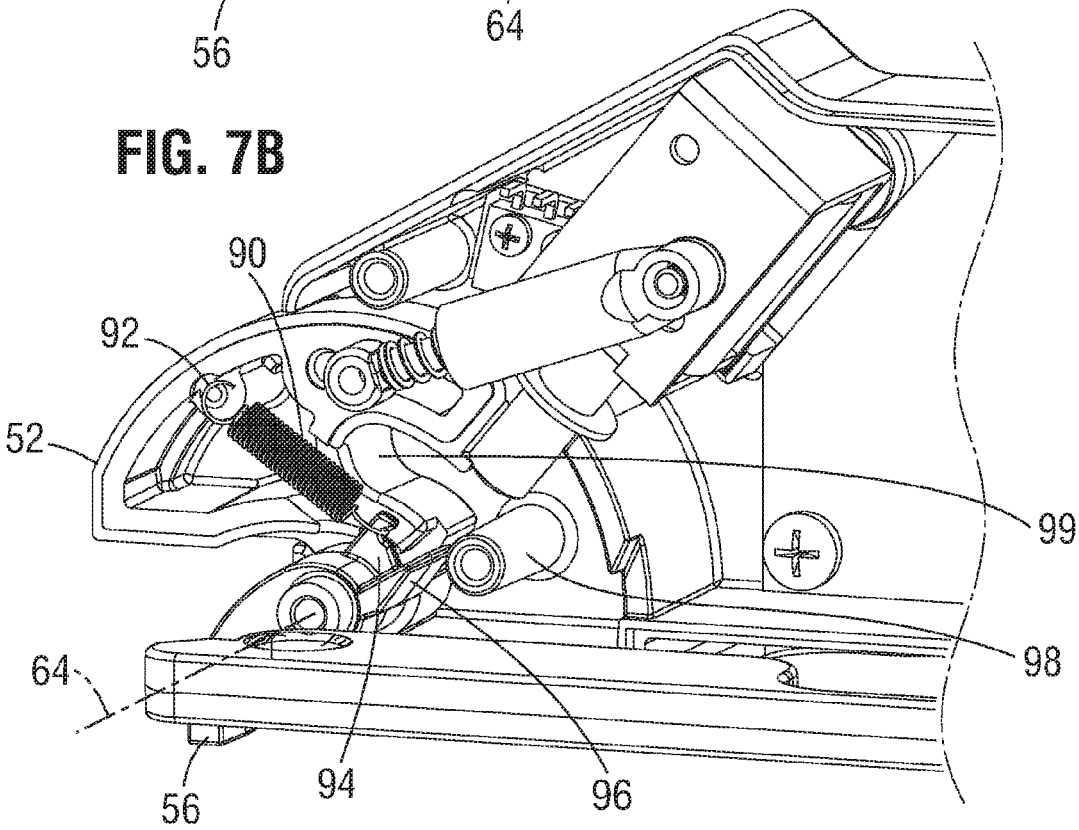

FIGS. 7A-7B are cutaway perspective views of the exemplary toggle lock 42 showing engagement of the toggle 56 with the rotating bolt 56. As mentioned, both the bolt 52 and toggle 56 rotate about the axis 64 fixed on the body 54. The toggle 56 is free to rotate with respect to the bolt 52 within limits, and is spring biased in the CCW direction relative to the bolt 52. More specifically, a coil spring 90 secures at one end to a pin 92 on the inside of the bolt 52 and at the opposite end to a finger 94 extending rearwardly from the toggle 56. Further, a small rearwardly-extending wedge-shaped projection 96 on the toggle 56 comes into contact with the inside face 81 of the bolt 52, as best seen in FIG. 4B. When the toggle 56 rotates in a CCW direction from contact with the door jamb 50, as seen in FIG. 5B, the wedge-shaped projection 96 rotates the bolt 52 as well. In this way, the toggle 56 and bolt 52 move together when the door is closed. Likewise, when the door opens the door jamb 50 forces the bolt 52 and toggle 56 to rotate CW in tandem. The spring 90 maintains the wedge-shaped projection 96 in contact with the inside face 81 of the bolt 52 so that the toggle does not swivel loosely and interfere with the subsequent door closing operation.

FIG. 7B illustrates a hard stop 98 for the bolt 52. Specifically, the stop 98 comprises a cylindrical post fixed within the body 54 that is received in a similarly shaped recess 99 formed in the rear face 81 of the bolt 52. CW rotation of the bolt 52 when opening the door eventually causes the plunger 66 to bias the recess 99 into contact with the post 98, thus limiting further travel.

Some of the lock features and differences are:

a. The present lock works on the plane of intended action, and is engineered to provide greater holding strength. Conventional "Slam Bolt" locks are adaptations of Boltwork Blocking Lock designs, where the intended locking direction is lateral in the direction of the Boltwork travel. These locks were never intended to be used where the forces are imposed in the axial direction, only lateral. Consequently, they are weak and easily broken or defeated in locker door use. In contrast, the present lock actuates in an axial direction following the direction of door travel. It is mechanically stronger in the direction of door motion.

b. The present lock provides better actuation, as it uses a rotational actuation path that follows the geometry of the closure mechanics. Slam bolt locks are loaded in an unnatural direction when the locker doors are pulled. Many times, the doors retain contents like cash bags that impose a load on the inside of the door, pushing the slam bolt into the jamb, impeding the free motion of the bolt to retract, thus causing failed openings. Many slam bolt locks are actuated by a solenoid pulling the bolt into the unlocked position. The present lock is held in the locked position by a strong spring detent plunger that prevents the unintended loads from hindering the lock actuation. Further, in a Slam Bolt lock the bolt is retracted my one of two types of designs, 1) Manual Knob on the face of the door, and 2) by a direct-drive Solenoid that pulls the bolt to the unlocked position. The direction of loads and resulting wear are imposed on surfaces that were not intended to be structurally loaded. The present lock bolt is a rotating component that is blocked by a blocking element controlled by a manual or electromechanical actuator such as a direct-drive solenoid. When the actuator is energized, the door can be pulled with moderate force to cause the bolt to "toggle" to the unlocked position. The spring loaded detent plunger works in an "over-center" action to also hold the bolt in an unlocked condition one the door is pulled open. There is a spring loaded release bar in the Bolt that contacts the jam during closure, which trips the rotating bolt back into the locking position.

c. The present lock is dead-locking, and cannot be articulated without using the intended electronics to actuate the blocking device. With a Slam bolt lock, the bolt can be pressed in against spring force, and cannot be dead-latched because it must be free to push in as it contacts the jamb during door closure. This is true for solenoid or knob actuated slam bolt locks. This presents a security risk, as opening can be accomplished by using a fishing probe from any opening where access may be made. The present lock is actuated by the pulling on the door (a pull knob is present, not shown). Once the bolt is locked, it cannot be moved to an unlocked position unless the internal blocking actuator is activated to provide the freedom of motion to rotate open.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A dead-locking slam bolt lock, comprising:

a body adapted to be mounted to an inside face of a door panel and carrying a bolt rotatable therein, the bolt having an advanced position extending from the body, which interferes with a door jamb to hold the door panel closed, and a retracted position within the body, the body further includes a toggle arranged to rotate with the bolt and having an extended position that contacts the door jamb and rotates the bolt when the door panel closes, the body further having a blocking member that prevents rotation of the bolt from the advanced position to the retracted position, and a detent plunger rotatably mounted within the body about a first end fixed with respect to the body and rotatably mounted to the bolt on a second end opposite the first end, the detent plunger being configured to apply opposite rotational spring-biases to the bolt depending on whether the bolt is in the advanced position or the retracted position.

2. The lock of claim 1, wherein the blocking member comprises a shaft not connected to rotate with the bolt that extends into a first position in a rotational arc of and physically blocking rotation of the bolt from the advanced position to the retracted position, the shaft being configured to retract to a second position out of the rotational arc of the bolt.

3. The lock of claim 1, wherein the toggle and the bolt rotate about a common axis.

4. The lock of claim 3, wherein the toggle includes a projection which contacts an inside face of the bolt and causes rotation of the bolt when the door panel closes, and the toggle is connected to the bolt via a tension spring that biases the projection against the inside face.

5. The lock of claim 1, wherein the bolt has a flat front face and a rounded rear face, and when in the advanced position, the flat face is juxtaposed against an inner face of the door jamb.

6. The lock of claim 1, wherein the blocking member comprises a solenoid shaft of an electronic solenoid which may be retracted to permit rotation of the bolt from the advanced position to the retracted position.

7. The lock of claim 1, wherein the body houses a hard stop for the bolt that limits travel of the bolt when the bolt rotates from the advanced position to the retracted position.

8. The lock of claim 6, wherein the bolt is free to rotate between the advanced and retracted positions under the influence of the opposite rotational spring-biases of the detent plunger when the solenoid shaft is retracted.

9. The lock of claim 1, wherein the detent plunger includes a piston terminating in the second end that slides within a cylinder attached to the first end, with a spring interposed therebetween to bias the piston out of the cylinder.

10. A locking container, including the lock of claim 1, the locking container comprising: the door panel to which the body of the lock is mounted, and a container body to which the door panel is hinged, the locking container defining a door frame that includes the door jamb which is engaged by the bolt.

11. A dead-locking slam bolt lock, comprising:

a body adapted to be mounted to an inside face of a door panel and carrying a bolt rotatable therein, the bolt having an advanced position extending from the body, which interferes with a door jamb to hold the door panel closed, and a retracted position within the body, the body further includes a toggle arranged to rotate about a common axis with the bolt and having an extended position that contacts the door jamb and rotates the bolt when the door panel closes, wherein the toggle includes a projection which contacts an inside face of the bolt and causes rotation of the bolt when the door panel closes, and the toggle is connected to the bolt via a tension spring that biases the projection against the inside face, the body further having a blocking member that prevents rotation of the bolt from the advanced position to the retracted position, wherein the blocking member comprises a solenoid shaft of an electronic solenoid which is configured to retract to permit rotation of the bolt from the advanced position to the retracted position, and wherein the solenoid shaft is configured to extend into a first position in a rotational arc of and physically blocking rotation of the bolt from the advanced position to the retracted position, the solenoid shaft being configured to retract to a second position out of the rotational arc of the bolt.

12. The lock of claim 11, wherein the bolt has a flat front face and a rounded rear face, and when in the advanced position, the flat face is juxtaposed against an inner face of the door jamb.

13. The lock of claim 11, wherein the body houses a hard stop for the bolt that limits travel of the bolt when the bolt rotates from the advanced position to the retracted position.

14. The lock of claim 11, further including a detent plunger that, depending on its rotational orientation, biases the bolt into its advanced position or its retracted position.

15. The lock of claim 14, wherein the detent plunger is rotatably mounted within the body about a fixed end and rotatably mounted to the bolt on a second end opposite the fixed end.

16. The lock of claim 15, wherein the detent plunger includes a piston terminating in the second end that slides within a cylinder attached to the fixed end, with a spring interposed therebetween to spring bias the piston out of the cylinder.

17. The lock of claim 14, wherein the blocking member has a first position in a rotational arc of and physically blocking rotation of the bolt from the advanced position to the retracted position, and the blocking member has a second position out of the rotational arc of the bolt, wherein the bolt is free to rotate between the advanced and retracted positions when the blocking member is in the second position and the detent plunger is configured to apply a bi-stable spring bias to the bolt which urges the bolt into the advanced position or the retracted position.

18. A locking container, including the lock of claim 11, the locking container comprising: the door panel to which the body of the lock is mounted, and a container body to which the door panel is hinged, the locking container defining a door frame that includes the door jamb which is engaged by the bolt.

19. A dead-locking slam bolt lock, comprising:

a body adapted to be mounted to an inside face of a door panel and carrying a bolt rotatable therein, the bolt having an advanced position extending from the body, which interferes with a door jamb to hold the door panel closed, and a retracted position within the body, the body further includes a toggle arranged to rotate about a common axis with the bolt and having an extended position that contacts the door jamb and rotates the bolt when the door panel closes, wherein the toggle includes a projection which contacts an inside face of the bolt and causes rotation of the bolt when the door panel closes, and the toggle is connected to the bolt via a tension spring that biases the projection against the inside face, the body further having a blocking member that prevents rotation of the bolt from the advanced position to the retracted position, the lock further comprising a detent plunger that, depending on its rotational orientation, biases the bolt into its advanced position or its retracted position.

20. The lock of claim 19, wherein the detent plunger includes a piston terminating in a second end of the detent plunger, and wherein the piston slides within a cylinder attached to a fixed end of the detent plunger, with a spring interposed therebetween to spring bias the piston out of the cylinder.

21. The lock of claim 19, wherein the blocking member comprises a solenoid shaft of an electronic solenoid which is configured to retract to permit rotation of the bolt from the advanced position to the retracted position.

22. The lock of claim 21, wherein the body houses a hard stop for the bolt that limits travel of the bolt when the bolt rotates from the advanced position to the retracted position, and wherein the bolt is free to rotate between the advanced and retracted positions when the solenoid shaft is retracted and the detent plunger is configured to apply a bi-stable spring bias to the bolt which urges the bolt into the advanced position or the retracted position.

* * * * *